US010865564B1

(12) United States Patent
Fuller

(10) Patent No.: US 10,865,564 B1
(45) Date of Patent: Dec. 15, 2020

(54) ROOF TRUSS SPACER

(71) Applicant: Federal Molding Corp., Chanhassen, MN (US)

(72) Inventor: Kevin S. Fuller, Chaska, MN (US)

(73) Assignee: Federal Molding Corp., Chanhassen, MN (US)

( * ) Notice: Subject to any disclaimer, the term of this patent is extended or adjusted under 35 U.S.C. 154(b) by 0 days.

(21) Appl. No.: 16/285,100

(22) Filed: Feb. 25, 2019

Related U.S. Application Data

(60) Provisional application No. 62/634,698, filed on Feb. 23, 2018.

(51) Int. Cl.
*E04C 3/04* (2006.01)
*E04C 3/02* (2006.01)
*E04G 21/18* (2006.01)

(52) U.S. Cl.
CPC ..... *E04C 3/04* (2013.01); *E04C 2003/026* (2013.01); *E04G 21/1891* (2013.01)

(58) Field of Classification Search
CPC .. E04C 3/04; E04C 2003/026; E04G 21/1891
See application file for complete search history.

(56) References Cited

U.S. PATENT DOCUMENTS 3,102,306 A 9/1963 Hutchinson
3,778,952 A * 12/1973 Soucy ..... E04B 2/763 52/667
4,246,736 A * 1/1981 Kovar ..... E04C 3/02 52/696
4,490,956 A * 1/1985 Palacio ..... E04C 3/02 411/466
4,669,235 A 6/1987 Reinen
5,580,036 A 12/1996 Browning
5,606,837 A 3/1997 Holizlander
(Continued)

FOREIGN PATENT DOCUMENTS

AU 2002313378 3/2007

OTHER PUBLICATIONS

Brochure by Metricon, Metricon puts Safety First, 2 pages, Australia, at least as early as Nov. 2012.
(Continued)

*Primary Examiner* — Adriana Figueroa
(74) *Attorney, Agent, or Firm* — Christensen, Fonder, Dardi & Herbert PLLC

(57) ABSTRACT

An interlocking elongate stackable spacer member for spacing structural framing members. The spacer is elongate having a lengthwise main portion and an offset portion, the offset portion defining a recess on a first side of the elongate body and a corresponding protrusion on a second side of the elongate body. The length of the protrusion corresponding to a desired spacing between adjacent trusses. The spacer can include a first end portion with a first connector and a second end portion having a cooperative second connector. The spacer is configured to interlock with another like spacer by inserting a first projection end portion of the first connector, into an aperture of the second connector, of the other of the spacer and the another spacer, such that the first projection end portion and the aperture of the second connector resist separation of the spacer and the another spacer along the lengthwise axis.

19 Claims, 18 Drawing Sheets

(56) References Cited

U.S. PATENT DOCUMENTS

| | | | | |
|---|---|---|---|---|
| 5,884,448 | A | 3/1999 | Pellock | |
| 5,893,253 | A | 4/1999 | Lutz, III | |
| 5,899,042 | A | 5/1999 | Pellock | |
| 6,354,055 | B1 * | 3/2002 | Shaw | E04B 7/022 52/696 |
| 6,393,794 | B1 * | 5/2002 | Pellock | E04B 7/024 52/203 |
| 6,418,695 | B1 * | 7/2002 | Daudet | E04B 7/022 52/639 |
| 6,993,882 | B2 * | 2/2006 | Crawford | E04B 7/022 52/696 |
| 7,213,377 | B1 | 5/2007 | Sackett | |
| 7,377,048 | B2 | 5/2008 | Koetter | |
| 7,520,100 | B1 * | 4/2009 | Herrman | E04B 2/7457 52/238.1 |
| 7,596,921 | B1 * | 10/2009 | diGirolamo | E04C 3/07 52/696 |
| 7,748,187 | B2 * | 7/2010 | Sensenig | E04B 5/12 52/480 |
| 7,836,657 | B1 * | 11/2010 | diGirolamo | E04C 3/07 52/712 |
| 8,176,648 | B2 | 5/2012 | Bradley | |
| 8,191,335 | B2 | 6/2012 | Davis | |
| 8,205,402 | B1 * | 6/2012 | diGirolamo | E04B 2/765 52/241 |
| 8,443,568 | B2 * | 5/2013 | Lin | E04D 12/004 52/655.1 |
| 9,003,738 | B1 * | 4/2015 | Evans, Jr. | E04B 5/12 52/702 |
| 9,062,455 | B2 * | 6/2015 | Rice | E04B 2/7457 |
| 9,085,888 | B2 * | 7/2015 | Fuller | E04B 7/024 |
| 9,435,119 | B2 * | 9/2016 | Fuller | E04B 7/024 |
| 10,214,902 | B1 * | 2/2019 | Wheeler | E04O 3/07 |
| 2002/0092259 | A1 | 7/2002 | Crawford et al. | |
| 2006/0196068 | A1 | 9/2006 | Thompson et al. | |
| 2009/0151294 | A1 * | 6/2009 | Staley | E04B 7/063 52/655.1 |
| 2011/0154770 | A1 | 6/2011 | Friis | |
| 2012/0159296 | A1 | 6/2012 | Rebstock et al. | |
| 2012/0180422 | A1 * | 7/2012 | Noturno | E04G 21/1891 52/696 |

OTHER PUBLICATIONS

Duvoisin, Safety and Speed Make Truss Spacers an On-Site Winner, MiTek, Melbourne Australia, 3 pages, at least as early as Nov. 2012.

Brochure of Gang-Nail® Truss Spacer Installation Instructions, MiTek®, 1 page, at least as early as Nov. 2012.

* cited by examiner

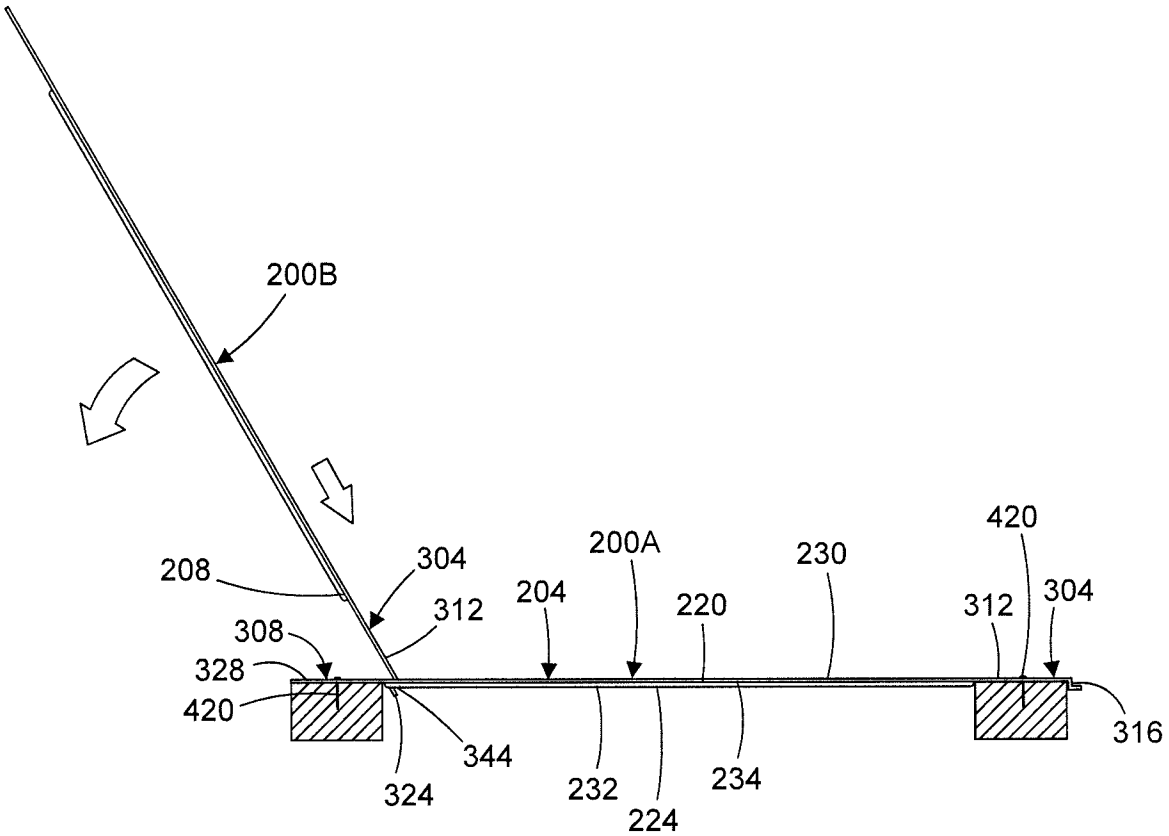
FIG. 4D
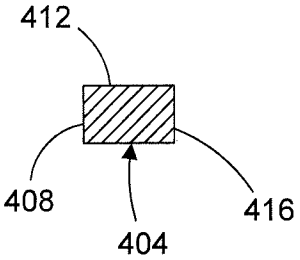

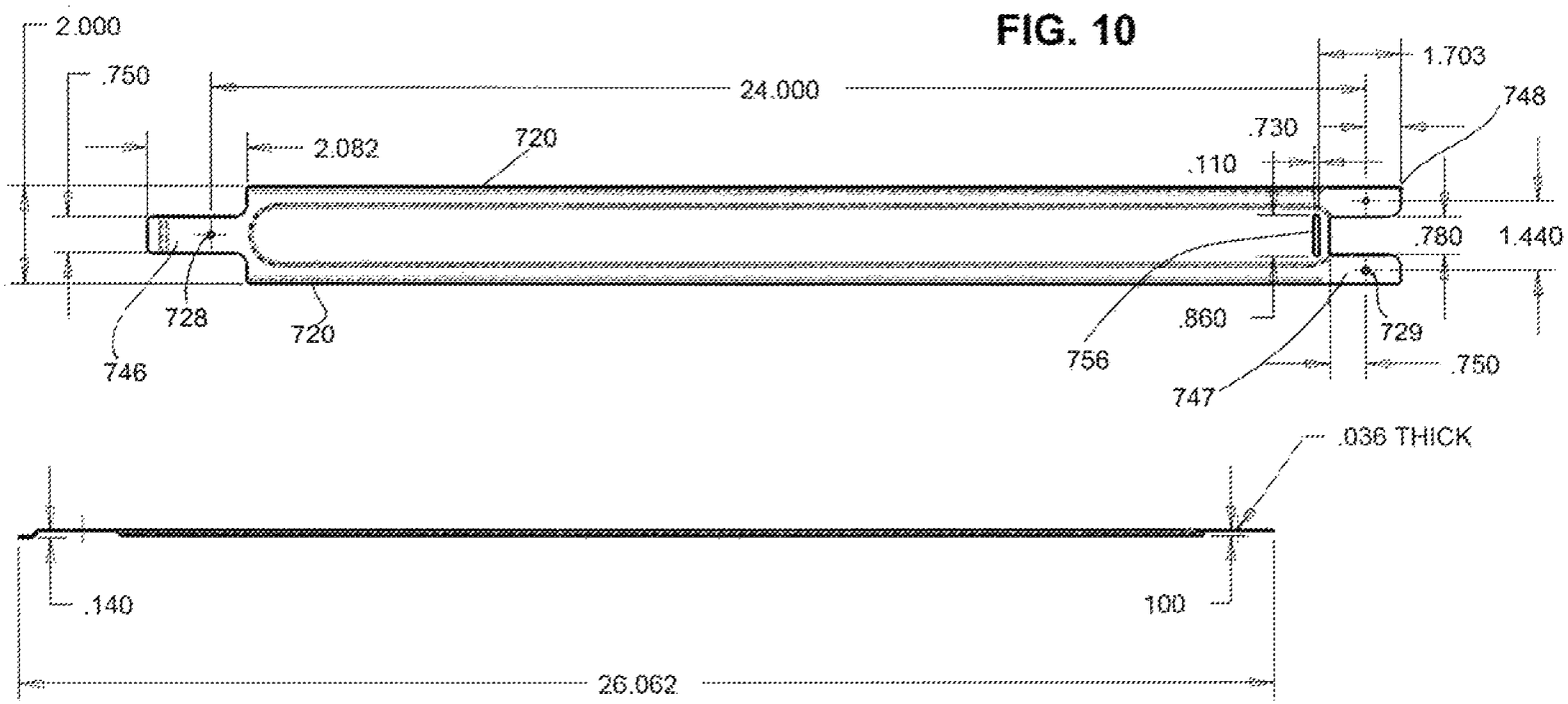
FIG. 10
FIG. 9
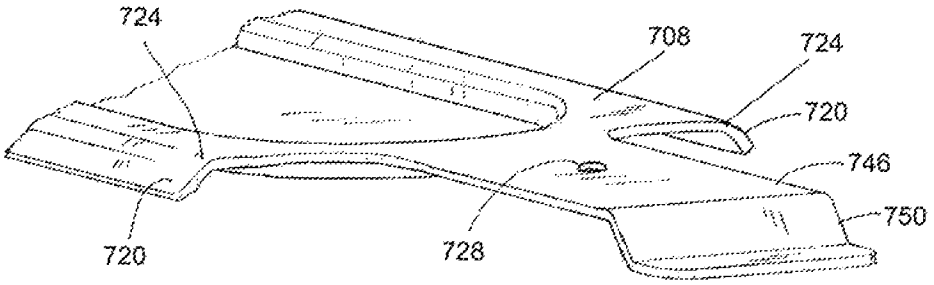
FIG. 8

ROOF TRUSS SPACER

This application claims priority to U.S. Provisional Application No. 62/634,698 filed on Feb. 23, 2018. Said application is incorporated by reference herein.

FIELD OF THE DISCLOSURE

The present disclosure relates to spacing members for positioning structural framing members, and more specifically, to spacing members for spacing, aligning, or otherwise for correctly positioning roof trusses and/or roof rafters during construction.

BACKGROUND

Accurate placement of structural framing members such as beams, joists, rafters, and particularly roof trusses can require several manual steps (e.g., measuring, positioning, re-measuring, temporarily tacking or bracing the members, etc.) that can result in tedious progress and less than safe intermediate placement as the framing members are erected into a building.

Various different approaches have been applied to reduce the time and increase the safety of building structural support structures. For example, known spacers are generally attached to framing members during the erection of a structure when the framing members are positioned in their final or near final positions in the structure. Typically, this involves manual attachment of both ends of the spacer onto the framing members. In some instances known spacers provide a brace with a pivotal connection to a framing member and a free swinging end. As such, the brace has a first transport and handling position which then rotates to a second use position for attaching to another framing member.

However, various known spaces present a variety of safety hazards to workers, such as, for example, during handling, storage, transport, or while in use. For example, several known spacers do not lay flush against the surface of framing members when in the first transport and handling position, rather they include portions that extend upwardly/downwardly, or present exposed metal corners. Such portions present a safety hazard to workers and, in some instances, can subject the spacer or other elements to damage by contact with the exposed portions of the spacer during handling, storage, or transport.

It would be beneficial to minimize the number of operations and the simplicity of operations related to utilizing spacers on elevated structural members. Fewer operations and simpler operations on elevated structural members provide a safer and more efficient framing operation.

Moreover, roof trusses are manufactured in truss manufacturing facilities and are shipped bundled in stacks, to job sites where they are generally individually elevated to their final support position and nailed into place. As such, it would be advantageous to have spacers with a design that provides advantages to bundling, shipping, and that have minimal portions protruding away from the truss during such transportation, handling, and hoisting of the trusses.

In addition, several patented apparatus and methods have been applied to reduce the time and increase the safety of building structural support structures. For example, see Australian patent number AU 20022313378 owned by Mitek Holdings Inc., issued 15 Mar. 2007, and captioned "Building Frame Member and Brace,"; U.S. Pat. No. 8,191,335 captioned, "Framing Guide" issued to Mark K. Davis on 5 Jun. 2012; U.S. Pat. No. 8,176,648 captioned, "Construction Spacer" issued to Bret Bradley on 15 May 2012; U.S. Pat. No. 7,213,377 captioned, "Device and Method for Spacing and Bracing Framing Components" issued to Gerald Sackett on 8 May 2007; and U.S. Pat. No. 6,993,882 captioned, "Truss Spacer and Brace" issued to Crawford et al. on 7 Feb. 2006; U.S. Pat. No. 5,884,448 captioned, "Truss Spacer and Support, Method of Use and Structures Made Therewith" issued to Michael Pellock on 23 Mar. 1999; U.S. Pat. No. 8,683,772 captioned "Truss Mounting Brace" issued to Friis on Apr. 1, 2014; U.S. Pat. No. 9,085,888 captioned "Structural Support Spacer" issued to Fuller et al., on 21 Jul. 2015. Each of the foregoing issued patents are incorporated by reference herein in their entirety. In addition to these issued patents, U.S. published patent application no. 2012/0180422 to Sam Norturno (published 19 Jul. 2012) captioned "Truss Spacer" is incorporated by reference herein in its entirety.

SUMMARY

One or more embodiments of the disclosure are directed to an interlocking spacer member for precise spacing between structural framing members, such as for example, roof trusses, beams, joists, and rafters.

In various embodiments the spacer includes an elongate body extending between a first end portion and a second end portion along a lengthwise axis, the elongate body having a main portion and an offset portion, the main portion having a substantially planar shape and the offset portion being offset from the planar shape of the main portion such that the offset portion defines, with respect to the main portion, a recess on a first side of the elongate body and a corresponding protrusion on a second side of the elongate body. In various embodiments the first end portion includes a first connector, the first connector including a projection extending in a first direction along the lengthwise axis and away from the elongate body and having a first projection end portion offset from a remainder of the projection and extending in a second direction perpendicular to the planar shape of the main portion. In one or more embodiments the second end portion includes a second connector, the second connector including an aperture sized to receive the first projection end portion.

In various embodiments the spacer is configured to interlock with another spacer by inserting the first projection end portion of the first connector, of one of the spacer and the another spacer, in the aperture of the second connector, of the other of the spacer and the another spacer, such that the first projection end portion and the aperture of the second connector resist separation of the spacer and the another spacer along the lengthwise axis.

A feature and advantage of embodiments of the disclosure is a spacer configured as an elongate thin strip portion with a pair of connectors capable of toollessly interlocking with connectors of one or more additional spacers to form a chain or link of a plurality of spacer members for correctly positioning a plurality of framing members. As such, in various embodiments, the spacers can be temporarily attached to one another easily and quickly, without the requirement of a fastener or other device to secure the spacer members together. In addition, a feature and advantage of embodiments of the invention is that the spacers are stackable. In one or more embodiments the stack us formed where the protrusion on the second side of the main portion nests with the corresponding recess on the first side of the main portion with adjacent spacers in the stack.

Finally, various embodiments of the disclosure are directed to a method of positioning a plurality of framing members using a first and a second spacer member, as described above. In one or more embodiments the method includes positioning the first spacing member between a first pair of chords that make up a portion of two adjacent framing members of the plurality of framing members. In various embodiments the pair of chords includes a first pair of side surfaces and a second pair of opposing side surfaces, the first pair of side surfaces and the second pair of side surfaces defining a pair of opposing corners in the two adjacent framing members. In certain embodiments the first spacing member is positioned such that the first and second connectors of the first and second end portion are placed on the first pair of side surfaces, with the second side of the spacer placed directly against the first pair of side surfaces, such that the protrusion of the spacer is positioned directly between the second pair of opposing side surfaces. In one or more embodiments the method includes fastening each of the connector portions of the first spacer member to each of the first pair of chords and interlocking the second spacer member to the first spacer member.

In one or more embodiments the first and second spacer member are interlocked by inserting the first projection end portion of the second spacer member in the aperture of the second connector of the first spacer member, and by positioning the second spacer member such that the main body of the second spacer member lies substantially parallel with the first spacer member and such that the second spacer member is positioned between a second pair of chords of two adjacent framing members of the plurality of framing members. In various embodiments the second pair of chords including a first pair of side surfaces and a second pair of opposing side surfaces, the first pair of side surfaces and the second pair defining a pair of opposing corners in the two adjacent framing members of the second pair of chords. In certain embodiments, as a result of positioning the second spacer member, the first and second connectors of the first and second end portion are placed on the first pair of side surfaces with the second side of the second spacer placed directly against the first pair of side surfaces such that the protrusion of the second spacer member is positioned directly between the second pair of opposing side surfaces. In one or more embodiments the method includes fastening each of the connector portions of the second spacer member to each of the second pair of chords.

A feature and advantage of embodiments is a stackable truss spacer that has a vertical dimension of less than about ⅜ inches, that does not have any vertically extending walls, that is a wall with opposing wall surfaces, the wall surfaces being vertical, only horizontal surfaces and surfaces angled from horizontal thereby permitting like trusses to be vertically stacked. In embodiments, a main planar portion has an offset portion projecting downwardly therefrom defining an upwardly facing recess and providing two opposite abutment portions having a non horizontal surface for the adjacent trusses to butt up against. The distance being about 22 and ⅝ inches between projections.

In embodiments, a pair of truss spacers interlock end to end with interlacing portions and having apertures positioned at one of 16 inches on center or 24 inches on center. The spacers vertically stackable with the height of the stack less than the height of each spacer times the number of spacers. The spacers vertically stackable with the height of the stack less than 70% of the height of each spacer times the number of spacers.

In embodiments a truss spacer is formed of sheet metal about 0.035 inches thick. And has apertures indicating truss spacing of 24 inches on center. In embodiments the sheet metal may be from 0.025 to 0.050 inches thick.

In embodiments the truss spacer is about 26 inches long and has a vertical height of less that about 3/16 inches, and has a width of about 2 inches. "About" when used herein means the dimensions may be within 20% of the given dimension.

In embodiments, a vertical stack of sheet metal trusses formed of stamped sheet metal having a thickness t and each spacer having a vertical height of at least t×2, or 2t, and where in the stack has a stack height of 1.2×n (number of spacers)×t, or less. "×" is multiplied by.

In embodiments, a vertical stack of sheet metal trusses formed of stamped sheet metal having a thickness t and each spacer having a vertical height of at least t×2, or 2t, and where in the stack has a stack height of 1.6×n (number of spacers)×t, or less. "×" is multiplied by.

The above summary is not intended to describe each illustrated embodiment or every implementation of the present disclosure.

BRIEF DESCRIPTION OF THE SEVERAL VIEWS OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

FIGS. 4A-4G depict spacing members in various stages of use for positioning a plurality of framing members, according to one or more embodiments of the disclosure.

FIG. 8 depicts a perspective portion of an end of another embodiment with the lengthwise edge portions flared downwardly.

FIG. 9 is a side elevation view of the spacer of FIG. 8 with exemplary dimensions.

FIG. 10 is a top plan view of the embodiment of FIG. 9 with exemplary dimensions.

Figure 1:
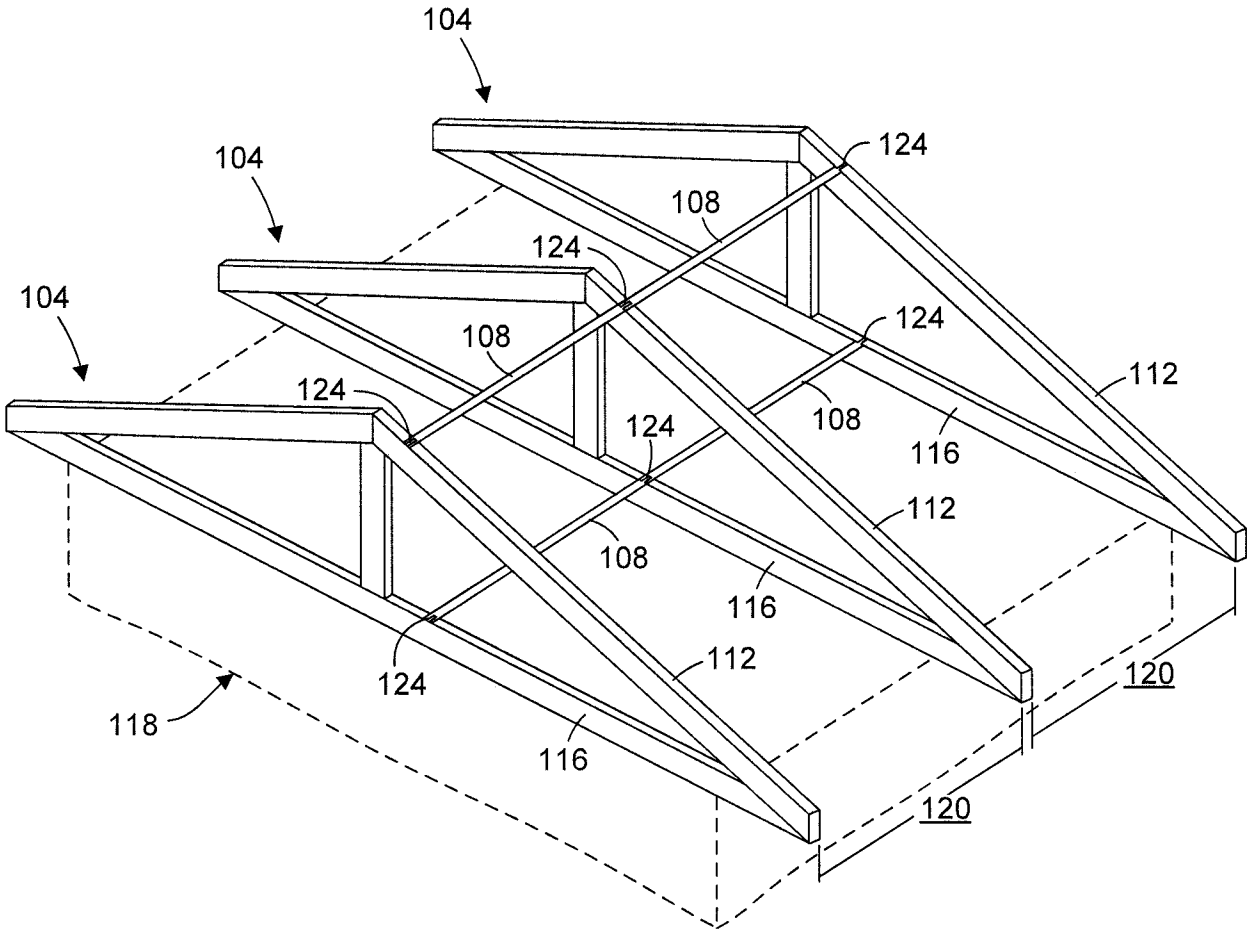
FIG. 1 depicts a perspective view of a plurality of framing members with a plurality of spacer members, according to one or more embodiments of the disclosure.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

FIG. 1 is a perspective view of a plurality of framing members 104 with a plurality of spacer members 108, according to one or more embodiments of the disclosure. Depicted in FIG. 1, framing members 104 are a plurality of roofing trusses each having a top chord 112 and bottom chord 116, and positioned adjacent to one another to form at least a portion of a structural framing for a roof of a structure 118.

Spacer members 108 are positioned between each of the adjacent framing members 104 to properly space, position, and/or align each of the framing members 104 at a planned or pre-determined distance 120 from one another during erection of the structure. Described further below, in one or more embodiments the spacer members 108 are elongate members having a pair of connectors 124 that are positioned at either end thereof. Depicted in FIG. 1, connectors 124 of each of the spacer members 108 are connected to top chords 112 and bottom chords 116 of adjacent framing members 104 resulting in the spacing distance 120. As such, in various embodiments spacing distance 120 is controlled or defined by the spacing members 108 as being approximately equal to a longitudinal length of each of the spacing members 108.

In addition, in one or more embodiments spacing distance 120 can vary. For example, distance 120 can be any acceptable spacing that is determined by the builder, engineer, or architect as a desirable spacing for the structure 118 being erected. As such, in various embodiments, and described further below, the longitudinal length of the spacing members 108 can vary to conform to the various building requirements of the structure 118.

While framing members 104 are depicted in FIG. 1 as a plurality of roofing trusses, in various embodiments framing members 104 could be structural framing for any portion of a structure. For example, framing members 104 could include structural framing for interior/exterior walls, flooring, or other portion of the structure. In one or more embodiments framing members 104 could be constructed from various kinds of material, including but not limited to, wood, metal, polymer, concrete, or other suitable material.

In addition, in certain embodiments, framing members 104 are prefabricated, such that each of the framing members 104 are fabricated at a first assembly site which is remote from a second erection site. In one or more embodiments, once fabricated, the framing members 104 can be transported to the second site by various well-known means and, once at the second site, the framing members 104 can be erected as a part of the structure 118, secured in place by various conventional means and properly spaced from the one another by the various embodiments of the disclosure. In addition, in certain embodiments spacer members 108 can be distinct from framing members 104 and attached to the framing members 104 during the erection process. In some embodiments spacer members 108 could be attached to each framing member 104 during fabrication. For example, in such embodiments, the framing members 104 could include, upon fabrication of the framing members 104, at least one spacer member 108 mounted on the top and/or bottom chords 112, 116.

In such embodiments, a first end or connector 124 of spacer members 108 can be pivotally attached to the framing members 104 while a second free end or connector 124 of the spacer members 108 may be temporarily held against the framing members 104 by any suitable means. In such embodiments spacer members 108 may be rotated before erection so as to be in the position as shown in the arrangement of FIG. 1.

Figure 2A:
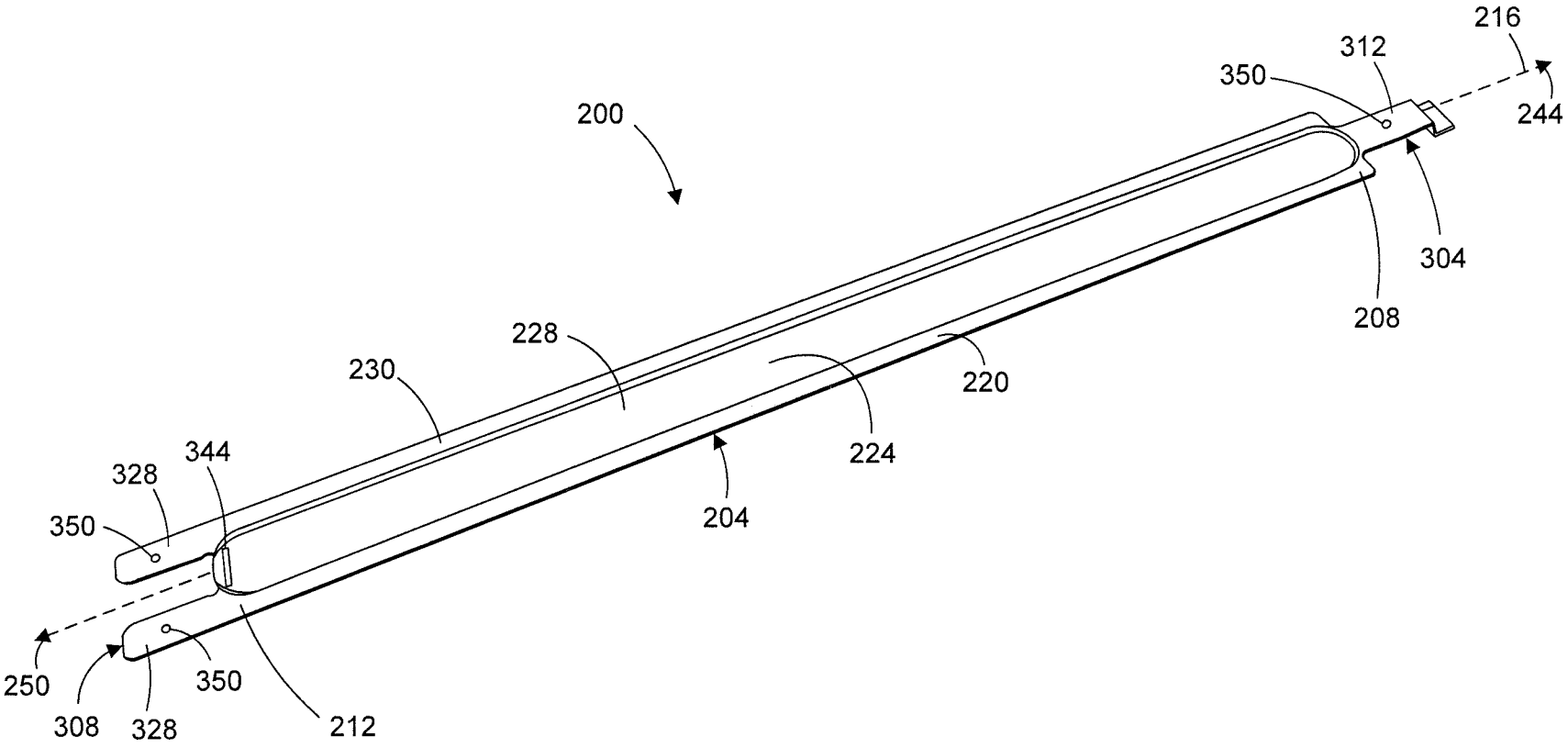
FIGS. 2A-2C depict a spacer member according to one or more embodiments of the disclosure.
Figure 2B:
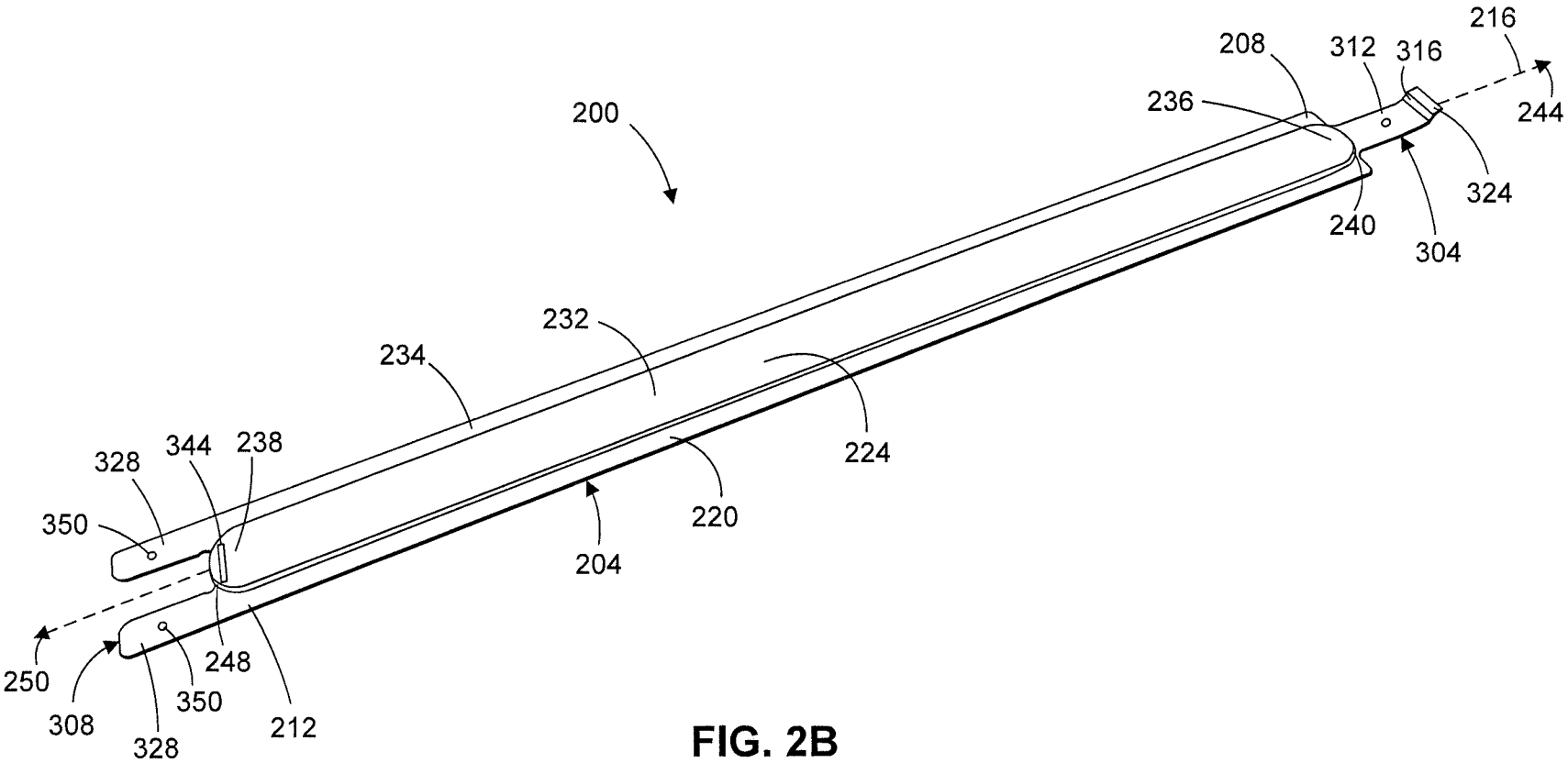
Figure 2C:
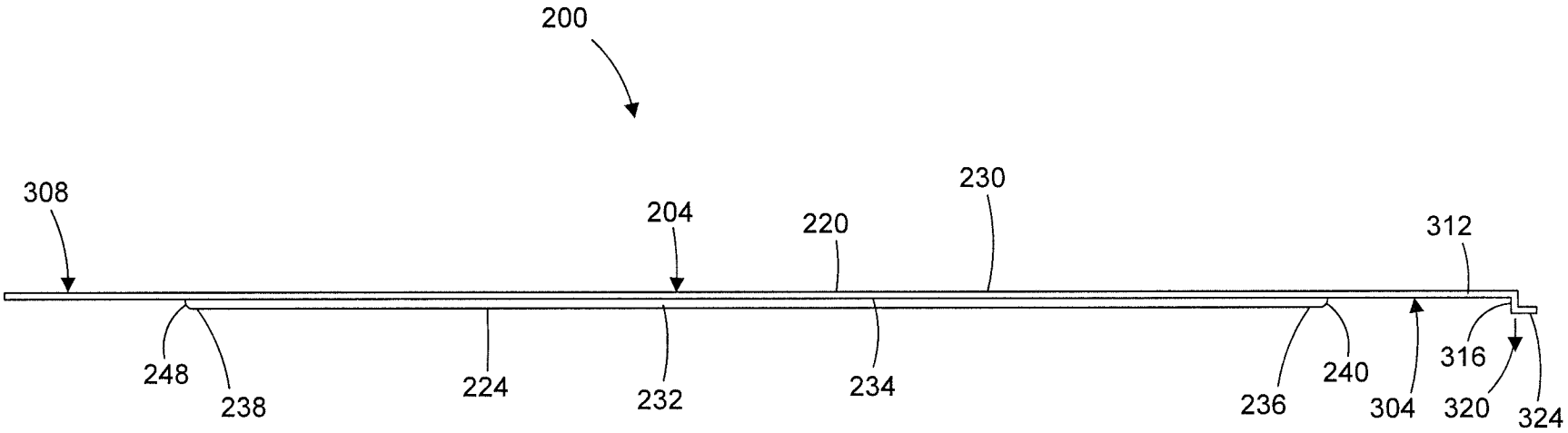
Figure 3A:
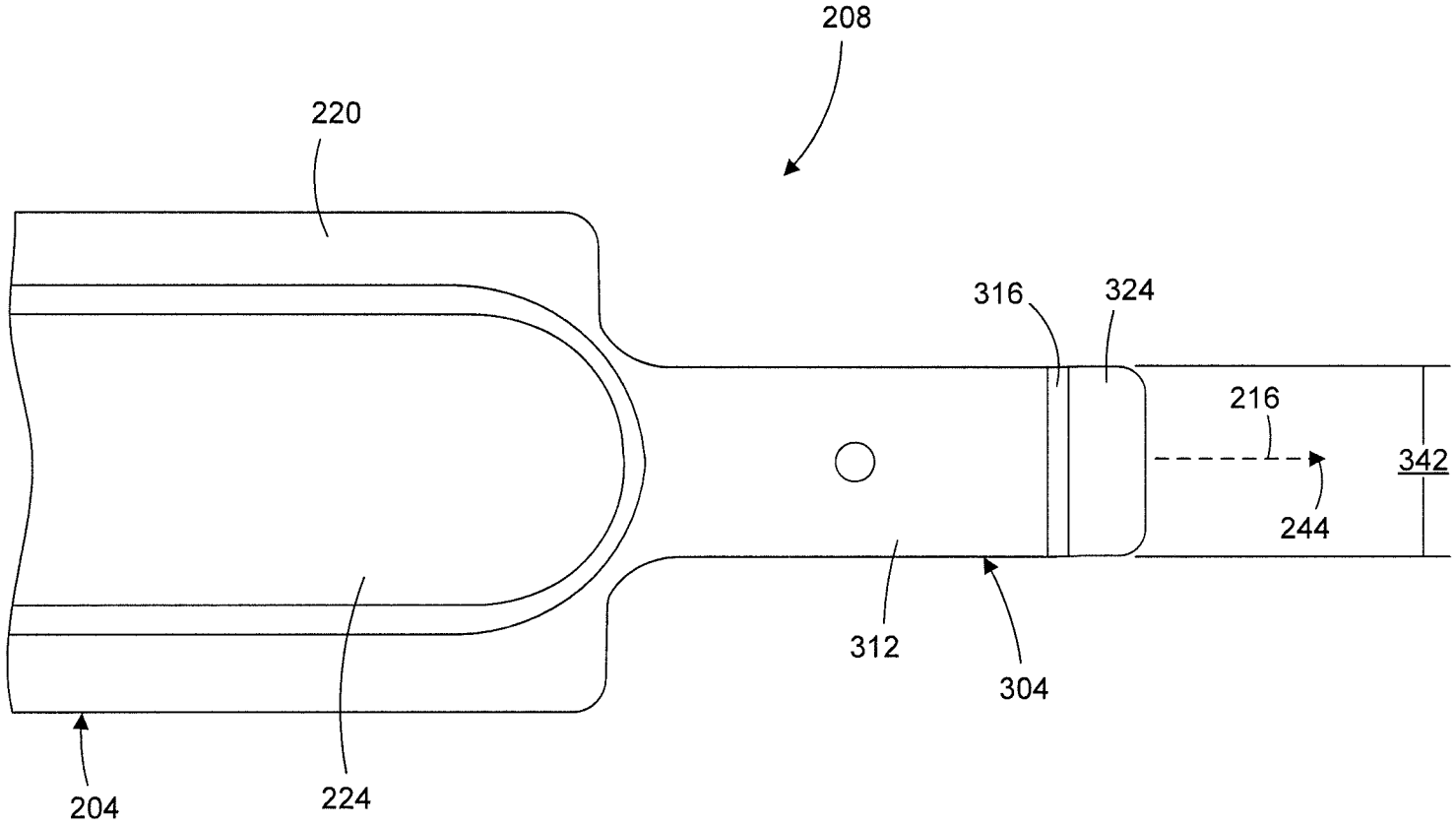
FIGS. 3A-3B depict views of a first end portion and a second end portion of a spacer member, according to one or more embodiments of the disclosure.
Figure 3B:
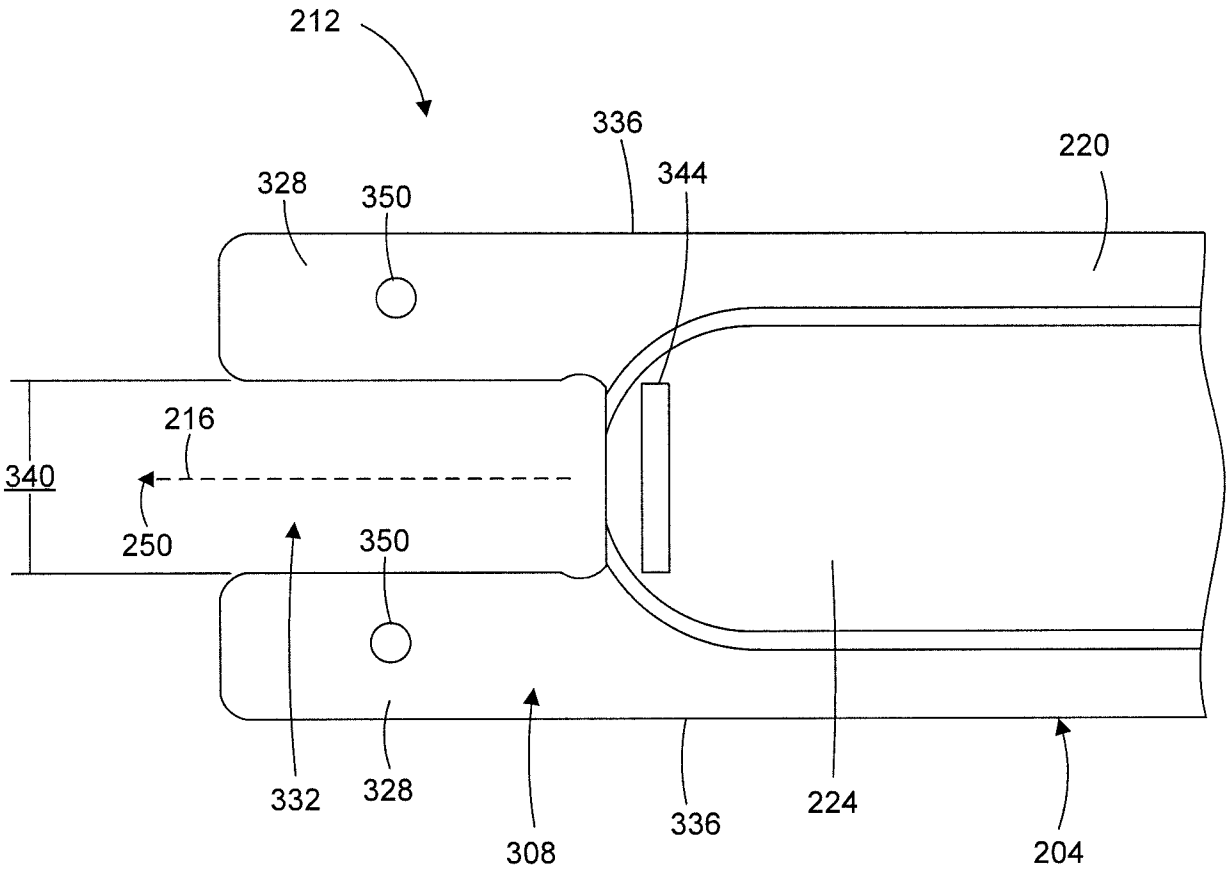

FIGS. 2A-2C depict a spacer member 200 according to one or more embodiments of the disclosure. In various embodiments the spacer member 200 has an elongate body 204 extending between a first end portion 208 and a second end portion 212 along a lengthwise axis 216.

In one or more embodiments the elongate body 204 has a main portion 220 and an offset portion 224. In various embodiments the main portion 220 has a substantially flat or planar shape, while the offset portion 224 is offset from the flat or planar shape of the main portion 220 such that the offset portion 224 defines a recess 228 on a first side 230 of the elongate body 204, depicted in FIG. 2A, and a corresponding protrusion 232 on a second side 234 of the elongate body 204, depicted in FIG. 2B.

As depicted in FIGS. 2A-2C, in various embodiments the offset portion 224 defines a single continuous projection or protrusion 232 that extends along the elongate body 204 from a first protrusion end portion 236 to a second protrusion end portion 238. As such, in various embodiments, first protrusion end portion 236 presents a first protrusion end surface 240 that faces in a first direction, indicated by arrow 244 along the lengthwise axis 216, and the second protrusion end portion 238 presents a second protrusion end surface 248 that faces in a second direction, indicated by arrow 250.

The protrusion end surfaces defining truss abutment surfaces and as described further below, in one or more embodiments the protrusion 232 and protrusion end surfaces 240 and 248 function to properly position and to resist undesired lateral movement of the spacer 200 by positioning the first and second protrusion end surfaces 240 and 248 adjacent to and between opposing side surfaces of adjacent framing members before and/or while the spacer 200 is fully secured in place.

Figure 7:
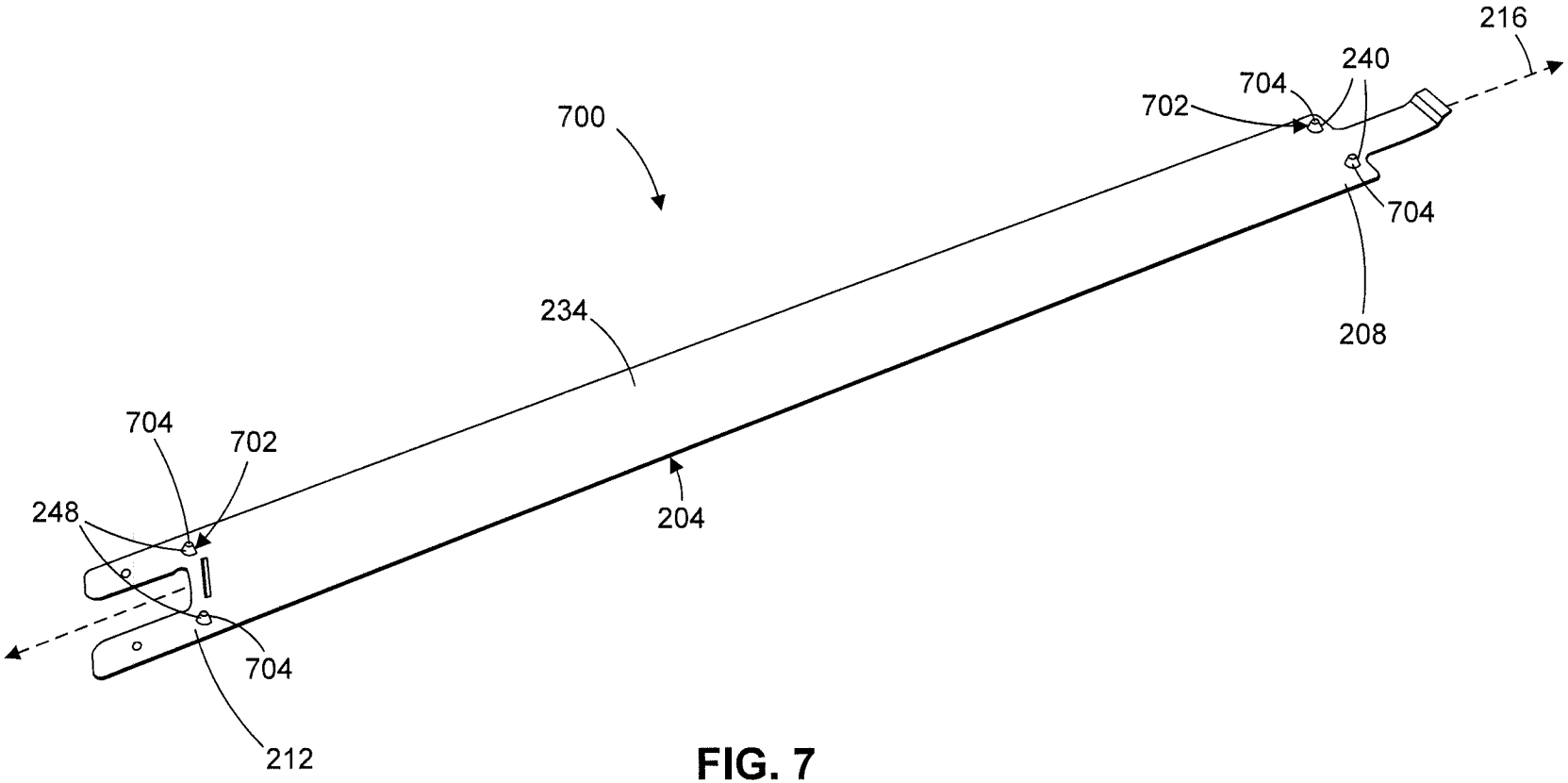
FIG. 7 depicts a perspective view of a spacer member, according to one or more embodiments of the disclosure.

Referring to FIG. 7, while FIGS. 2A-2C above depict a single continuous protrusion 232, in certain embodiments a spacer 700 could include an offset portion 702 that instead defines a plurality of protrusions 704 on the second side 234 of the elongate body 204. In such embodiments, one or more of the plurality of protrusions 704 are positioned at the first end portion 208 and one or more others of the plurality of protrusions 704 are positioned at the second end portion 212 of the elongate body 204 such that the plurality of protrusions 704 continue to define the protrusion end surfaces 240, 248 for properly positioning and resisting undesired lateral movement of the spacer 700 while in use.

Referring again to FIGS. 2A-2C, and referring additionally to 3A-3B, close up views of the first end portion 208 and the second end portion 212 are depicted according to one or more embodiments of the disclosure. In various embodiments the first end portion 208 includes a first connector 304 and the second end portion 212 includes a second connector 308. In various embodiments the first connector 304 is an axially extending projection 312 extending in the first direction, indicated by arrow 244, along the lengthwise axis 216 away from the elongate body 204. In such embodiments, the projection 312 includes a first projection end portion 316 that is offset from the remainder of the projection 312 by extending in a third direction, indicated by arrow 320, perpendicular to the planar shape of the main body 220 and in substantially the same direction as the offset protrusion 232.

In some embodiments, and depicted in FIGS. 2A-2C, and 3A-3B, the projection additionally includes a second projection end portion 324 extending in the first direction, indicated by arrow 244, to define a substantially "L" shape for the end of the first connector 304, especially when viewed from the side, such as for example depicted in FIG. 2C.

In various embodiments, the second connector 308 includes a pair of axially extending arms 328 extending in the second direction, indicated by arrow 250, along the lengthwise axis 216 and away from the elongate body 204. In various embodiments the pair of axially extending arms 328 are spaced apart from one another to define an axially extending space 332 or void between the arms 328. For example, depicted in FIG. 3B, the pair of axially extending arms 328 are positioned at lengthwise edges 336 of the elongate body 204 and are separated by and define the space 332. In various embodiments, the space 332 has a size or width defined by a distance 340 between each of the arms 328 such that the width of the space 332 is slightly larger than a width 342 of the projection 312 of the first connector 304. For example 0.05% to 5% larger.

As such, and described further below, in various embodiments the first connector 304 can be received between the arms 328 for connecting the spacer 200 to another spacer member. In addition, in various embodiments the second connector 308 additionally includes an aperture 344. In one or more embodiments, and described further below, the aperture 344 is shaped and sized to receive the first and/or second projection end portions 316, 324 of the first connector 304 for interlocking the spacer 200 with another spacer member. For example, in one or more embodiments the spacer member 200 is configured to interlock with another spacer member by connecting the first connector 304 to the second connector 308. Specifically, in various embodiments the spacer member 200 is configured to interlock with another spacer by inserting the first projection end portion 316 of the first connector 304 of one spacer into the aperture 344 of the second connector 308 of the other spacer, such that the spacer and the other spacer are connected or held together by resisting lateral movement (e.g. movement along the lengthwise axis 216) apart from one another by the connection.

In one or more embodiments, the first and second connectors 304, 308 each include one or more apertures 350 for fastening the spacer 200 a framing member. For example, depicted in FIGS. 2A-2C, 3A-3B, spacer 200 includes a plurality of apertures 350 in the form of nail holes for nailing or otherwise securing each end of the spacer to a surface of a framing member, described further below.

While FIGS. 2A-2C, 3A-3B depict first connector 304 as a single projection 312 that, when in operation, is positioned between a pair of arms 328 and inserted into a single aperture 344 of the second connector 304, in certain embodiments this configuration could be reversed. For example, in some embodiments the first connector 304 could include a pair of projections 312 that, when in operation, are positioned on either side of a single axially extending arm 328 and are inserted into a pair of apertures 344 in the second connector 308.

In one or more embodiments, the spacer 200 can be formed of myriad materials such as metal or alloys, resin-based materials (e.g., extruded, co-extruded, or injection molded whether basic, reaction-injection molded, or whether combined with fibers for reinforcement, etc.), composite wood or hybrid composite materials, combinations thereof, and the like. In various embodiments the materials can be tempered to enhance the structural qualities thereof or cured in the case of resin-based materials, for example. In one or more embodiments, 20 gauge (20 GA) galvanized sheet metal is used to fabricate the spacer 200, although other materials and other gauges of sheet metal can of course be used.

Referring to FIGS. 4A-4G, spacing members 200 are depicted in various stages of use, according to one or more embodiments of the disclosure. Specifically, FIGS. 4A-4G depict various steps in a method of spacing a plurality of framing members 404, according to certain embodiments of the disclosure.

Figure 4A:
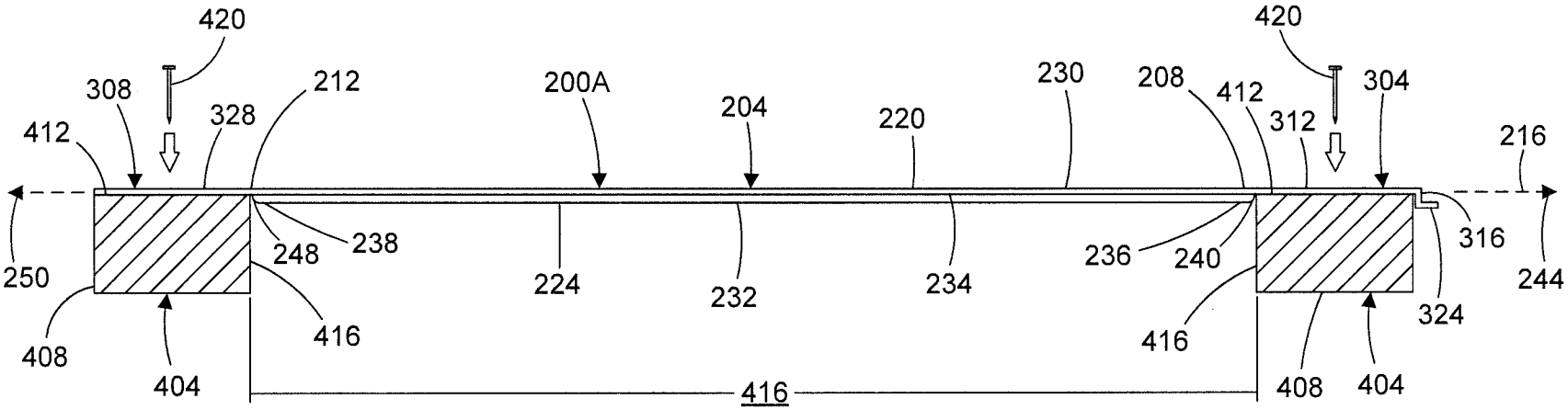
Figure 4B:
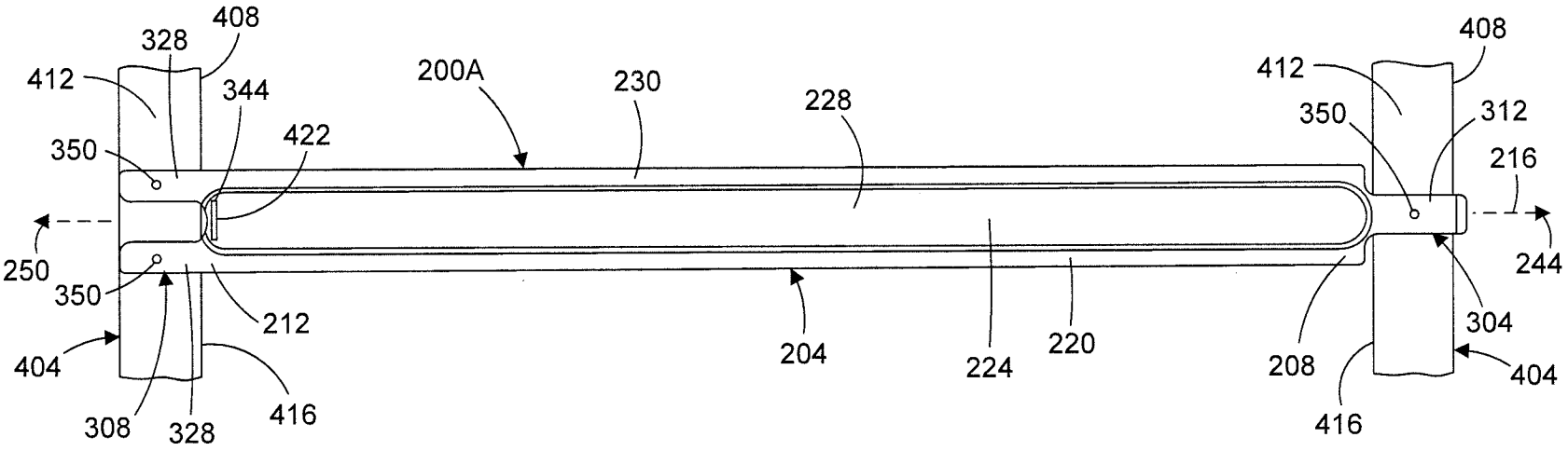
Figure 4C:
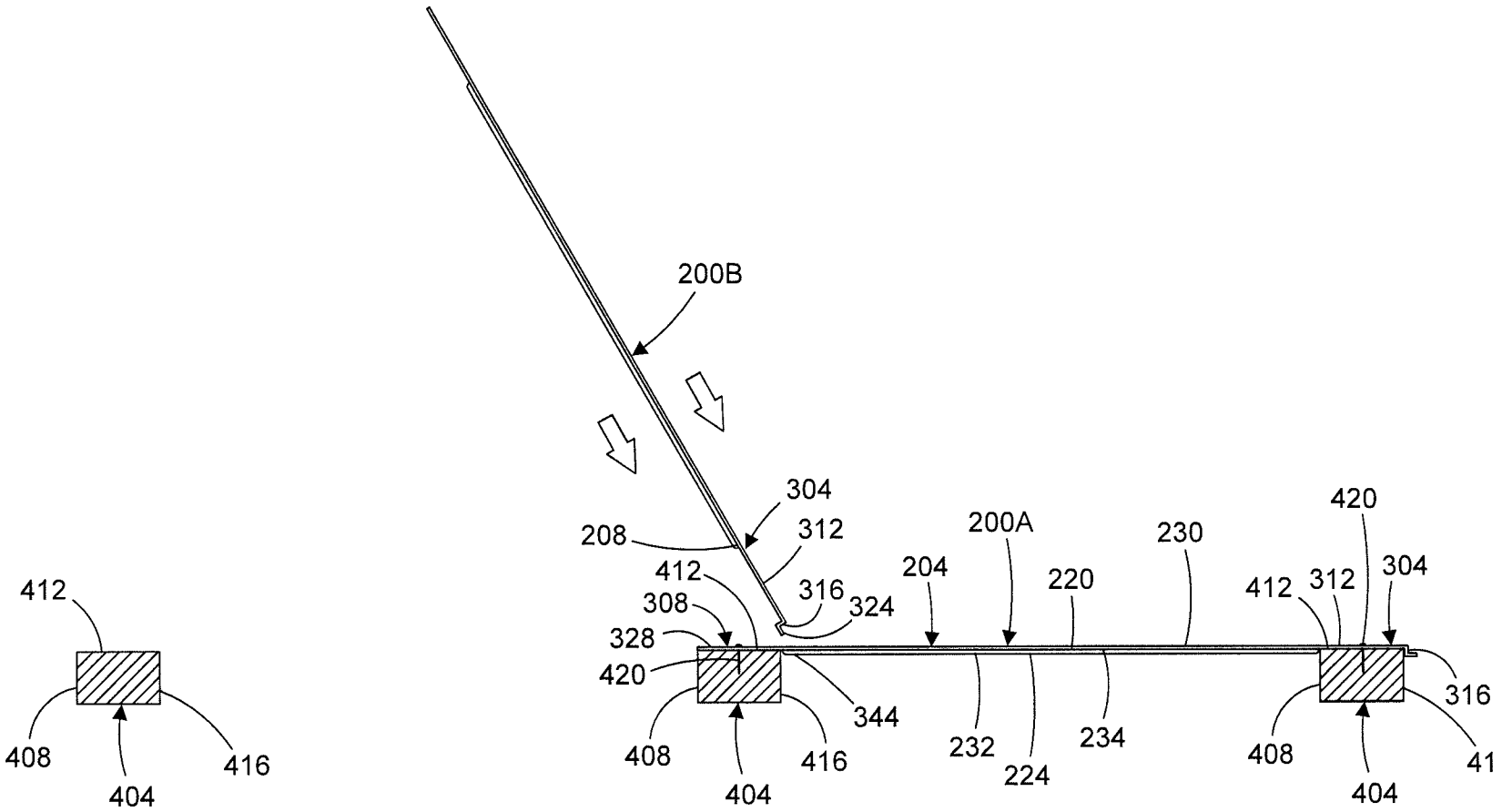
Figure 4E:
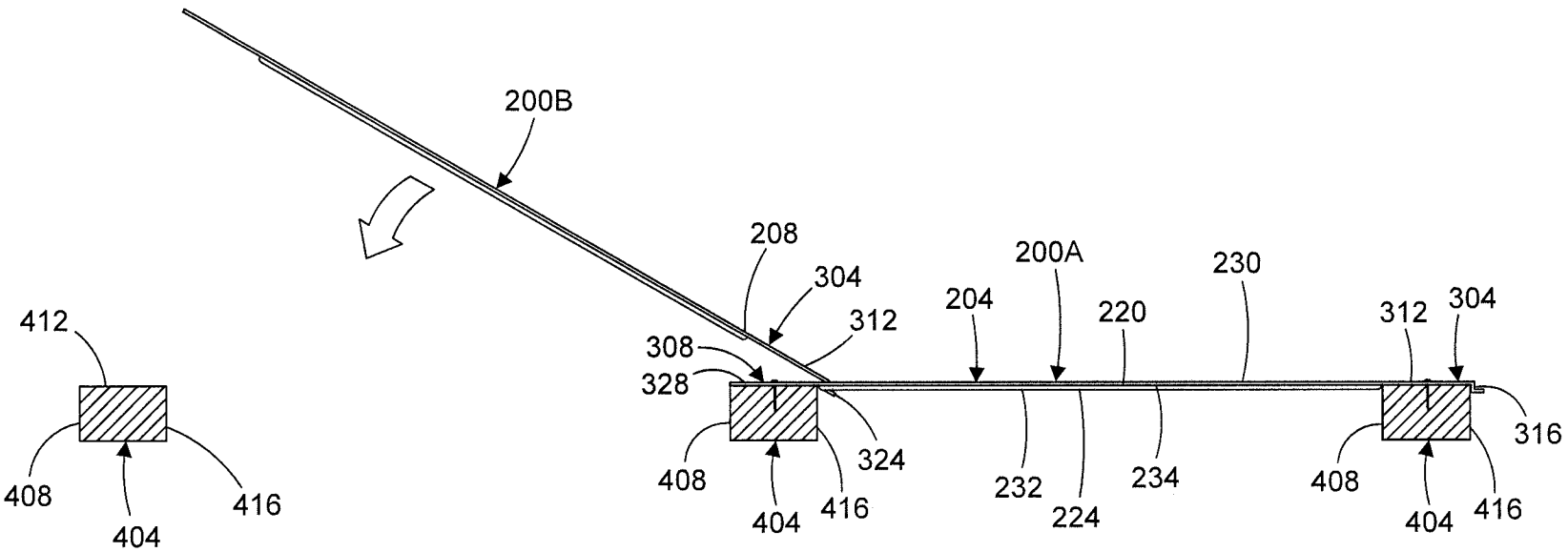
Figure 4F:
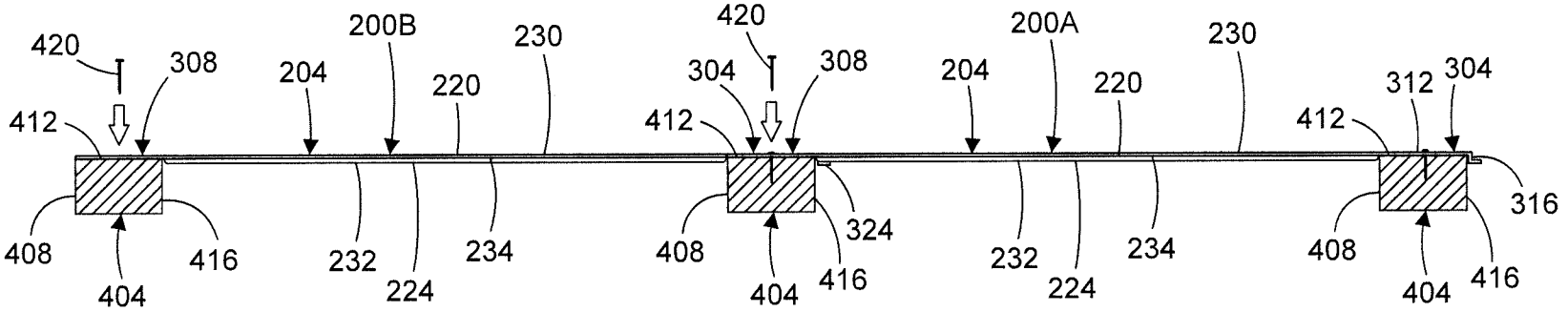
Figure 4G:
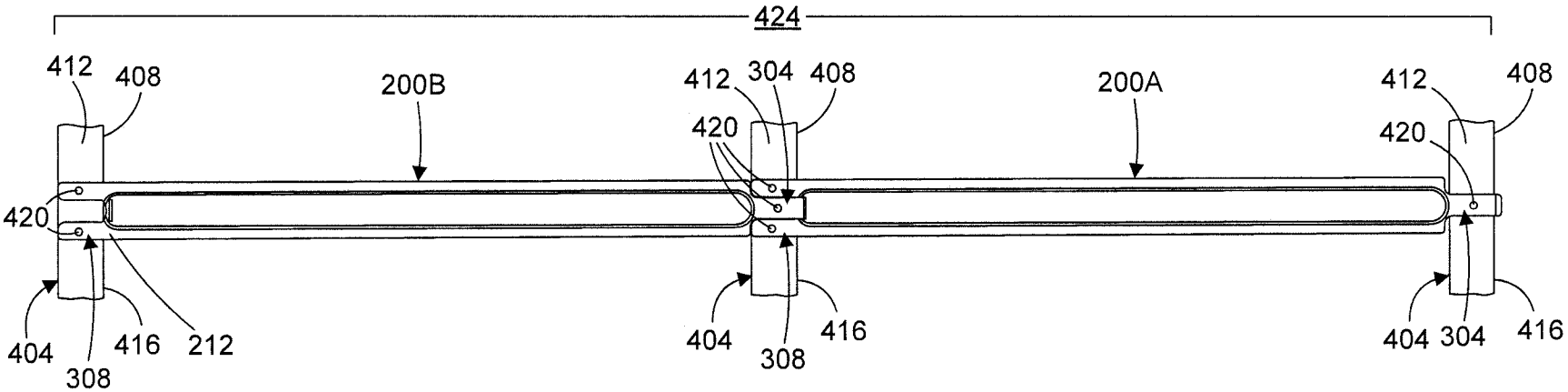

Depicted in FIG. 4A-4B, a first spacing member 200A is first positioned between a pair of chords 408 that make up at least a portion of two adjacent framing members 404, as described above.

In various embodiments each of the chords 408 of the framing members include a plurality of side surfaces including a first pair of side surfaces 412 and a second pair of opposing side surfaces 416. While the first pair of side surfaces 412 are depicted in FIGS. 4A-4G as upwardly facing, in various embodiments the first pair of side surfaces 412 includes side surfaces oriented in any direction. As such, the first pair of side surfaces 412 refers to side surfaces of the chords 408 that are generally oriented to face the same direction as one another.

In various embodiments, the first spacing member 200A is positioned between the pair of chords 408 to define a gap 416, along the lengthwise axis 216, between each of the framing members 404. Specifically, in one or more embodiments the first and second connectors 304, 308 of the first and second end portion 208, 212 are placed on the first pair of side surfaces 412 such that the main portion 220 of the elongate body is substantially positioned between each of the chords 408. As such, in various embodiments a length of the main portion 220 of the elongate body defines the size of the gap 416 for positioning or spacing the framing members 404, as described above with regard to FIG. 1.

In one or more embodiments the second side 234 of the spacer 200A is placed directly against the first pair of side surfaces 412. As such, in various embodiments the protrusion 232 of the spacer 200A extends outwardly from the elongate body 204 such that the protrusion 232 is positioned between each of the opposing side surfaces 416. In various embodiments, the first and second protrusion end surfaces 240 and 248 of the protrusion 232 abut the opposing side surfaces 416 of each of the chords 408. As such, in various embodiments the protrusion 232 halts or prevents movement of each of the chords 408, and as a result, each of the framing members 404, from moving closer to one another along the lengthwise axis 216. In addition, the first and second protrusion end surfaces 240 and 248 function to resist lateral movement of the spacer member 200A itself as the end surfaces 240, 248 abut the opposing side surfaces 416.

In one or more embodiments, once the first spacer member 200A is in place between the chords 408, the connector portions 304 and 308 of the spacer member 200A may be fastened or secured to the chords 408. For example, depicted in FIG. 4A, each of the connector portions 304 and 308 can be nailed, via nails 420, or otherwise secured to the chords via apertures 350 in each of the connector portions 304 and 308.

Depicted in FIGS. 4C-4F, once the first spacer member 200A is secured in place between the chords 408, in various embodiments a second spacer member 200B can be interlocked or connected with the first spacer member 200A to form a chain or series of connected spacer members for positioning additional framing members 404.

In various embodiments, to interlock the second spacer member 200B to the first spacer member 200A, the first connector 304 of the second spacer member 200B is first at least partially inserted into the aperture 344 of the second connector 308 of the first spacer member 200A. For example, depicted in FIGS. 4C-4D, the first and/or second protrusion end portion 316 and 324 of the second spacer member 200B are generally downwardly inserted into the aperture 344 of the first spacer member 200A. Once inserted, the second spacer member 200B is rotated such that the main body 220 of the second spacer member 200B lies substantially parallel with the first spacer member 200A. Further, in various embodiments, as a result of rotating the second spacer member 200B, the second connector 308 of the second spacer 200B is generally positioned onto the side surface 412 of the additional framing member 404 to space or position the additional framing member.

Further, as a result of the insertion the first connector 304 into the aperture 344 and subsequent rotation of the second spacer member 200B, the first protrusion end portion 324 abuts the edges 422 of the aperture 344 such that the first protrusion end portion 316 generally restricts or halts movement of the second spacer member 200B away from the first spacer member 200A in a lateral direction along the lengthwise axis 216. In addition, in various embodiments where the spacer member 200B includes the second protrusion end portion 324, the second protrusion end portion 324 is inserted through the aperture 344 and is rotated with the remainder of the spacer member 200B such that the second protrusion end portion 324 directly abut the second side 234 of the first spacer member 200A. In such embodiments, the second protrusion end portion 324 restricts or halts movement of the second spacer member 200B away from the first spacer member 200A in a direction perpendicular to the lengthwise axis 216.

As a result of the connection of the first connector 304 to the second connector 308 of the first spacer member 200A, the first and second spacer members 200A and 200B are interlocked or connected together and form a chain 424 of spacer members that functions to space or position a plurality of framing members 404. Further, as depicted in FIGS. 4C-4G this interlocking is performed toollessly, without the use of fasteners or other devices to connect the spacer members together.

In one or more embodiments, once the second spacer member 200B is in place between the chords 408, the connector portions 304 and 308 of the second spacer member 200B may additionally be fastened or secured to the chords 408. For example, depicted in FIG. 4A, each of the connector portions 304 and 308 can be nailed, via nails 420, or otherwise secured to the chords via apertures 350 in each of the connector portions 304 and 308 similarly to the first spacer member 200A depicted in FIG. 4A.

Figure 5:
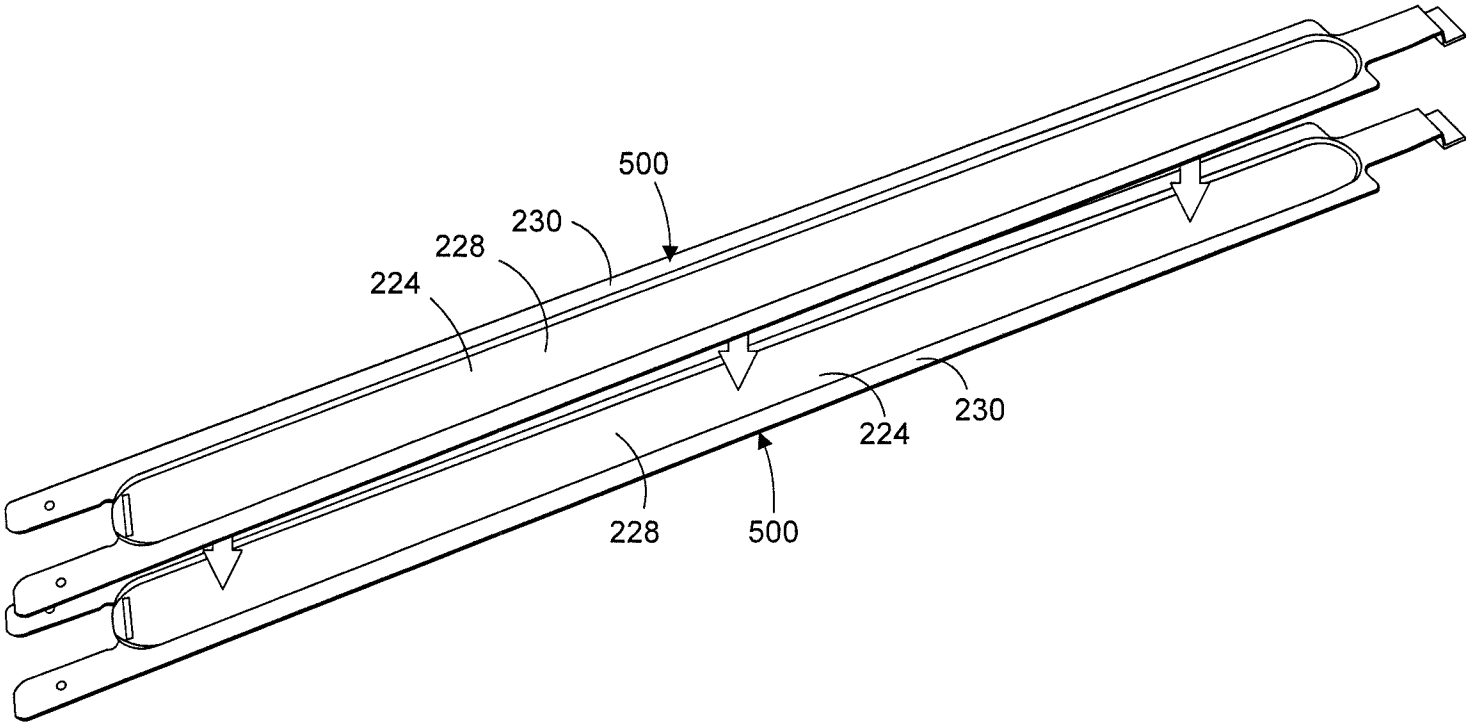
FIG. 5 depicts a perspective view of spacers oriented for nesting or forming a stack, according to one or more embodiments of the disclosure.
Figure 6A:
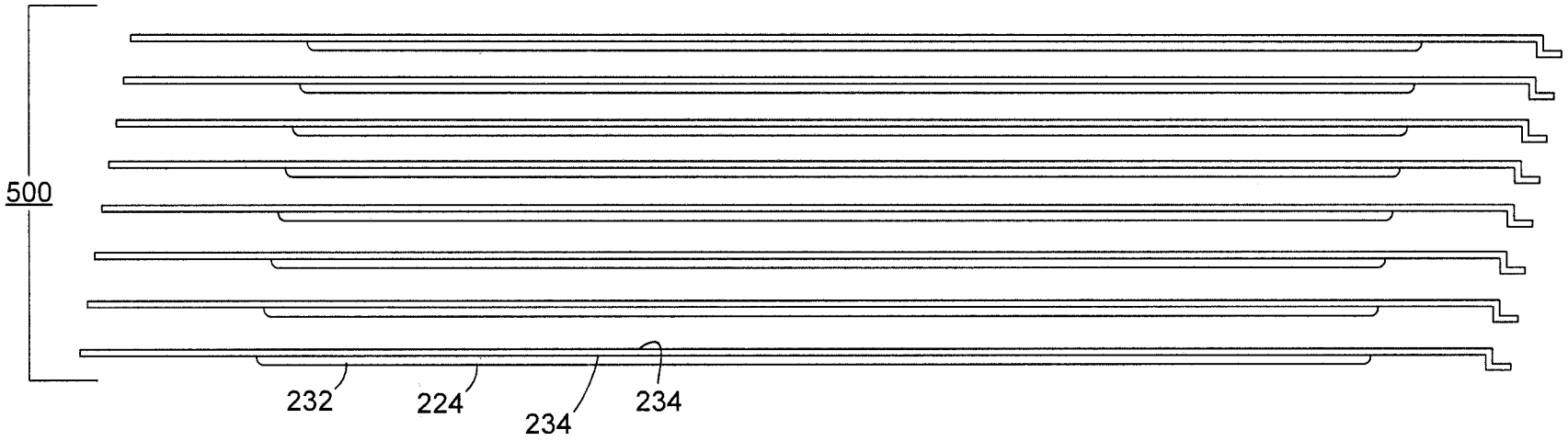
FIGS. 6A & 6B depicts side views of a plurality of spacers oriented for nesting or forming a stack, according to one or more embodiments of the disclosure.
Figure 6B:
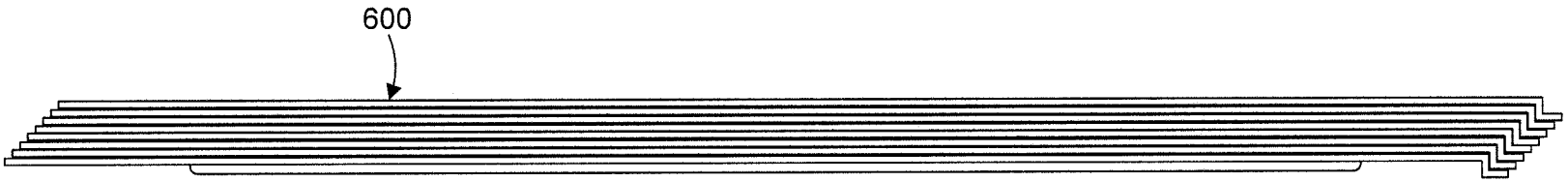
Figure 6C:
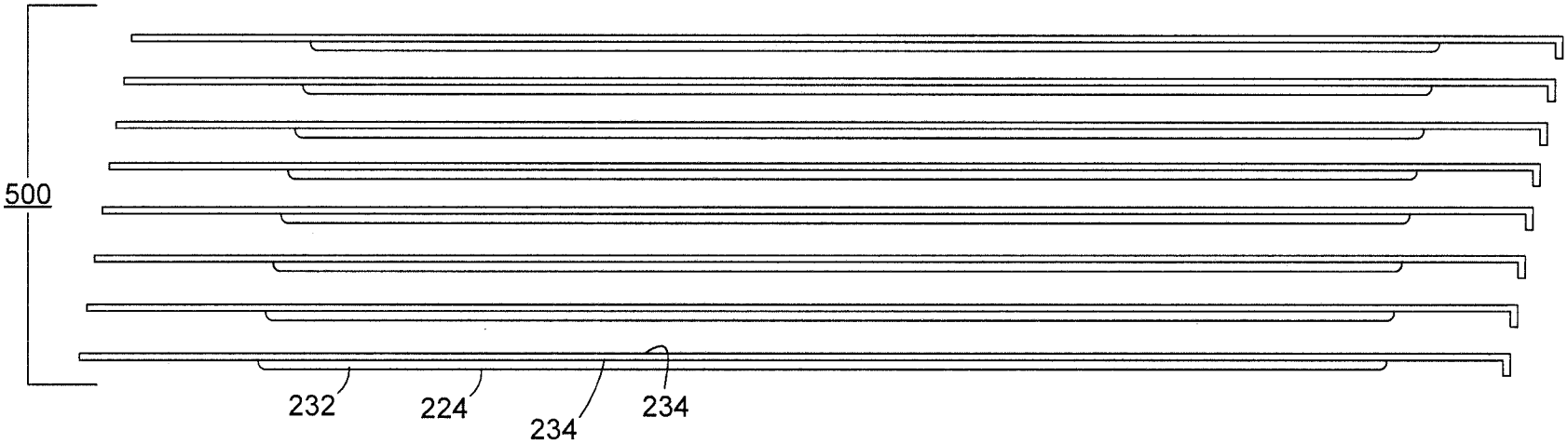
FIGS. 6C & 6D depict side views of a plurality of spacers oriented for nesting or forming a stack, according to one or more embodiments of the disclosure. This spacer has an L-shape at one end to interface with the slot at the other end.
Figure 6D:
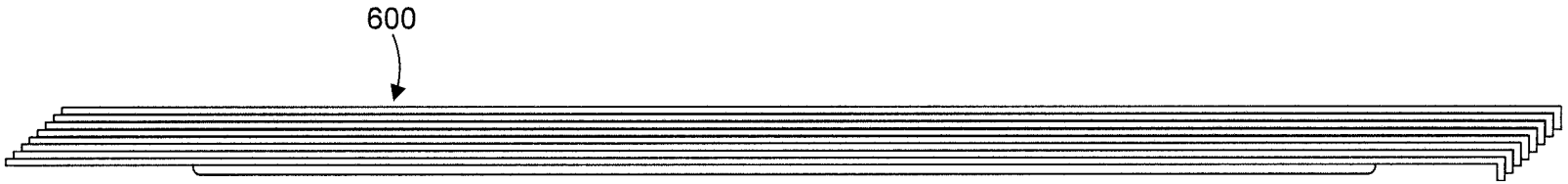
Figure 6E:
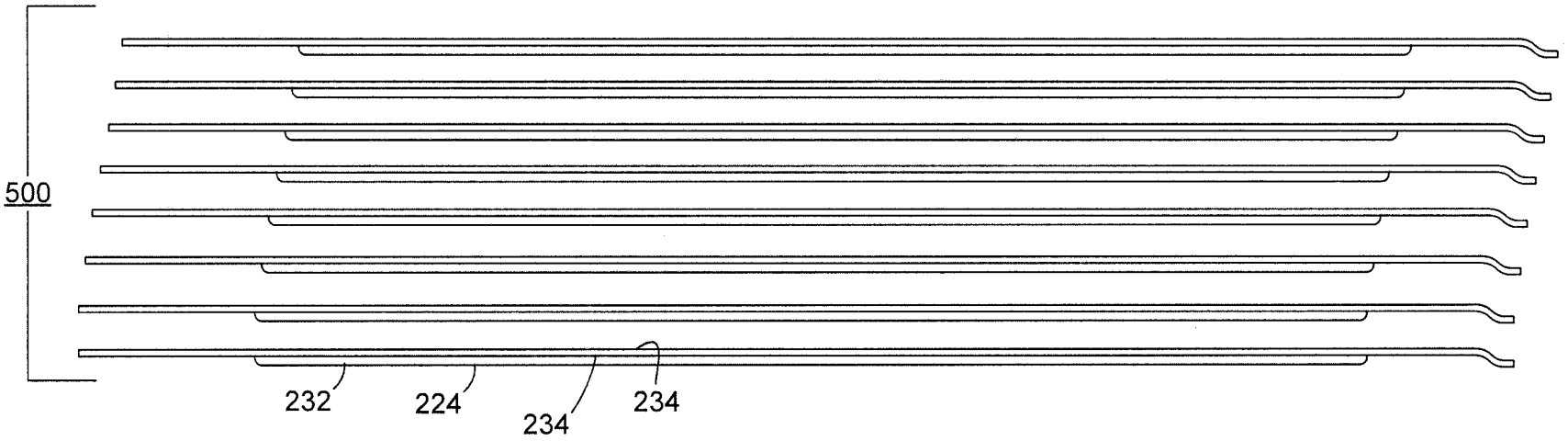
FIGS. 6E & 6F depicts side views of a plurality of spacers oriented for nesting or forming a stack, according to one or more embodiments of the disclosure. This embodiment does not having any vertically extending wall portions permitting the stacking height to be substantially the number of spacers times the sheet metal thickness of each spacer.
Figure 6F:
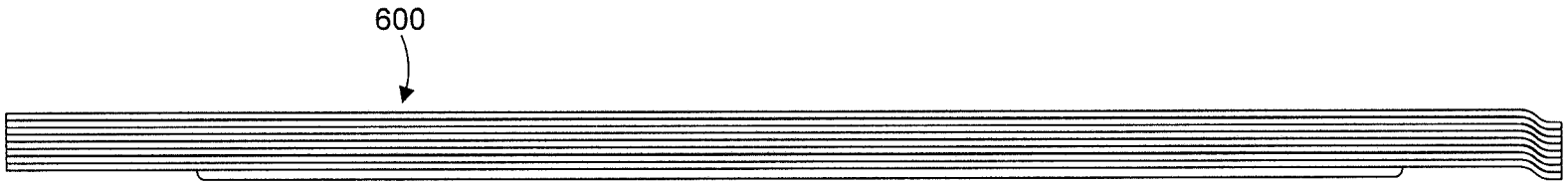

Referring to FIGS. 5 and 6A-6B a plurality of spacer members 500 are depicted oriented for nesting or forming a stack 600, according to one or more embodiments. In various embodiments spacer members 500 are substantially the same as spacer member 200, described above with reference to at least 2A-2C. As such, like elements of spacer members 500 are identified with like reference numerals.

In one or more embodiments, the plurality of spacer members 500 can be stacked together by aligning the offset portion 224 of each of the spacer members 500. For example, as described above, the offset portion 224 defines a recess 228 on a first side 230 of the spacer 500 and a corresponding protrusion 232 on a second side 234 of the spacer 500. In various embodiments, and depicted in FIGS. 5 and 6A-6B, each of the spacers 500 are aligned when the protrusion 232 is positioned over or with a corresponding recess 228 of an adjacent spacer member. Once aligned, the spacer members can be stacked by moving the plurality of spacer members 500 together such that the protrusion 232 of the spacer member 500 nests into a corresponding recess 228 to form the stack 600, such as depicted in FIG. 6B.

Referring to FIGS. 8-10, a spacer member 708 with a downwardly flared lengthwise edge portion 720 is depicted. Such additional structure providing an additional pair of lengthwise corners or bends 724 provide enhanced strength with respect to bending or buckling. Illustrative dimensions, in inches, are provided that are also applicable to other embodiments enclosed herein. A set of like spacers with the given dimensions would provide proper spacing for 24 inch on-center truss or other structural lumber arrangement with the holes 728, 729, suitable for nails, located precisely 24 inches apart. In embodiments, other acceptable truss spacings of 12 inches, or 16 inches, or 30 inches. The length dimensions control the structural member spacing and are thus much more critical than the width dimensions. In embodiments the dimensions may vary and in applications be within 10% of the given dimensions. The spacer member is utilized with a plurality of identical spacer member, each with a first end portion 740 and a second end portion 742, the first end portion having an axially extending projection 746 that horizontally interlaces with two axially extending projections 747, 748 on the second end of a cooperating like spacer member. The first end portion projection 746 also has an interlocking end projection 750 that extends into a slot 756 of the second end and that thereby interlocks the spacer member with the cooperating spacer member as described above in association with other embodiments.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. An interlocking sheet metal spacer for structural framing members, the spacer comprising:

an elongate body extending between a first end portion and a second end portion along a lengthwise axis;

the elongate body having a main portion and an offset portion, the main portion having a substantially planar shape and the offset portion being offset from the planar shape of the main portion such that the offset portion defines, with respect to the main portion, a recess on a first side of the elongate body and a corresponding protrusion on a second side of the elongate body;

the first end portion including a first connector, the first connector including a projection extending in a first direction along the lengthwise axis and away from the elongate body and having a first projection end portion offset from a remainder of the projection and extending in a second direction perpendicular to the planar shape of the main portion;

the second end portion including a second connector, the second connector including an aperture sized to receive the first projection end portion;

wherein the spacer is configured to interlock with another spacer by inserting the first projection end portion of the first connector, of one of the spacer and the another spacer, through the aperture of the second connector, of the other of the spacer and the another spacer, such that the first projection end portion and the aperture of the second connector resist separation of the spacer and the another spacer when the spacer and the another spacer are linearly aligned along the lengthwise axis, wherein the second connector includes a pair of arms extending in a second direction along the lengthwise axis and away from the elongate body, the pair of arms being spaced apart from one another to define an axially extending space therebetween having a width that is substantially the same or larger than a width of the projection of the first connector.

2. The spacer of claim 1, wherein the projection includes a second projection end portion extending in the first direction from the first projection end portion to define a substantially "L" shape for an end of the first connector.

3. The spacer of claim 1, wherein the first connector and the second connector each include one or more apertures, such that one of a nail, screw or staple can be utilized to attach the first connector and the second connector to a beam or chord of a structural framing member.

4. The spacer of claim 3, wherein the structural framing members includes a plurality of roofing trusses.

5. The spacer of claim 1, wherein the offset portion defines a single continuous protrusion that extends along the elongate body from a first protrusion end portion to a second protrusion end portion.

6. The spacer of claim 1, wherein the offset portion further defines a first protrusion end portion presenting a first protrusion end surface that faces in the first direction and a second protrusion end portion presenting a second protrusion end surface that faces in the second direction.

7. The spacer of claim 6, wherein the protrusion end surfaces are for properly positioning the spacer between opposing side surfaces of two adjacent framing members and for resisting undesired lateral movement of the spacer by positioning the first and second protrusion end surfaces adjacent to and between opposing side surfaces of adjacent framing members.

8. The spacer of claim 6, wherein the offset portion defines a plurality of protrusions, including the protrusion on the second side of the elongate body, one or more of the plurality of protrusions being positioned at the first end portion and one or more others of the plurality of protrusions being positioned at the second end portion.

9. The spacer of claim 8, wherein the one or more of the plurality of protrusions at the first end portion define the first protrusion end surface, and the one or more others of the plurality of protrusion define the second protrusion end surface.

10. The spacer of claim 1, wherein the spacer is stackable with one or more another spacers to form a stack, the stack formed where the protrusion on the second side of the main portion nests with the corresponding recess on the first side of the main portion with adjacent spacers in the stack.

11. The spacer of claim 1, wherein the elongate body has a pair of downwardly flared lengthwise edge portions.

12. A method of positioning a plurality of framing members using a first and a second spacer member, the first and the second spacer member each comprising an elongate body extending between a first end portion and a second end portion along a lengthwise axis, the elongate body having a main portion and an offset portion, the main portion having a substantially planar shape and the offset portion being offset from the planar shape of the main portion such that the offset portion defines, with respect to the main portion, a recess on a first side of the elongate body and a corresponding protrusion on a second side of the elongate body, the first end portion including a first connector, the first connector including a projection extending in a first direction along the lengthwise axis and away from the elongate body and having a first projection end portion offset from a remainder of the projection and extending in a direction perpendicular to the planar shape of the main portion, the second end portion including a second connector, the second connector including an aperture sized to receive the first projection end portion, the second connector additionally including a pair of arms extending in a second direction along the lengthwise axis and away from the elongate body, the pair of arms being spaced apart from one another to define an axially extending space therebetween having a width that is substantially the same or larger than a width of the projection of the first connector, the method comprising positioning the first spacer member between a first pair of chords that make up a portion of two adjacent framing members of the plurality of framing members, the pair of chords including a first pair of side surfaces and a second pair of opposing side surfaces, the first pair of side surfaces and the second pair of opposing side surfaces defining a pair of opposing corners in the two adjacent framing members, the first spacer member positioned such that the first and second connectors of the first and second end portions are placed on the first pair of side surfaces, with the second side of the first spacer member placed directly against the first pair of side surfaces, such that the protrusion of the first spacer member is positioned directly between the second pair of opposing side surfaces;

fastening each of the first and second connector portions of the first spacer member to each of the first pair of chords;

interlocking the second spacer member to the first spacer member by inserting the first projection end portion of the second spacer member through the aperture of the second connector of the first spacer member, and positioning the second spacer member such that the main body of the second spacer member lies substantially parallel with the first spacer member and such that the second spacer member is positioned between a second pair of chords of two adjacent framing members of the plurality of framing members, the second pair of chords including a first pair of side surfaces and a second pair of opposing side surfaces, the first pair of side surfaces and the second pair of opposing side surfaces defining a pair of opposing corners in the two adjacent framing members of the second pair of chords, where, as a result of positioning the second spacer member, the first and second connectors of the first and second end portion are placed on the first pair of side surfaces with the second side of the second spacer placed directly against the first pair of side surfaces such that the protrusion of the second spacer member is positioned directly between the second pair of opposing side surfaces; and fastening each of the first and second connector portions of the second spacer member to each of the second pair of chords.

13. The method of claim 12, wherein interlocking the first spacer member to the second spacer member is performed toollessly.

14. The method of claim 12, wherein, when one or more of the first and second spacer members are in position between one or more of the first and second pair of chords, a first protrusion end surface of the protrusion and a second protrusion end surface of the protrusion abut the opposing side surfaces of each of the chords to resist lateral movement of the spacer members along the lengthwise axis.

15. The method of claim 12, wherein, when one or more of the first and second spacer members are in position, the main portion of the elongate body is substantially positioned between each of the chords defining a gap between each of the framing members having a length substantially equal to a length of the main portion of the elongate body.

16. A truss spacer placed on the top surface of adjacent wooden trusses to properly space the adjacent wooden trusses during assemble of a structure comprising such wooden trusses, each spacer having a vertical height of less than ⅜ of an inch, having a main planar portion to rest on top surfaces of adjacent wooden trusses, and having an offset portion to extend downwardly between the adjacent wooden trusses, wherein the offset portion defines an aperture configured to interlock with an adjacent said spacer by receiving a projection of the adjacent spacer through the aperture, such that the projection of the adjacent spacer and the aperture resist separation of the spacer and the adjacent spacer when the spacer and the adjacent spacer are linearly aligned along the lengthwise axis.

17. The truss spacer of claim 16 further having a hole on a first end of the spacer and a hole on an opposite second end of the spacer, the holes spaced, center to center, one of 24 inches and 16 inches.

18. The truss spacer of claim 16 wherein two of said spacers interlock with one another end to end.

19. The truss spacer of claim 18 wherein two of said spacers interlace within a horizontal plane with one another on the top surface of the trusses.

* * * * *